US012565719B2

(12) United States Patent
Okuda et al.

(10) Patent No.: US 12,565,719 B2
(45) Date of Patent: Mar. 3, 2026

(54) CARBON FIBER AND METHOD OF MANUFACTURING SAME

(71) Applicant: Toray Industries, Inc., Tokyo (JP)

(72) Inventors: Haruki Okuda, Iyo-gun (JP); Fumihiko Tanaka, Iyo-gun (JP)

(73) Assignee: Toray Industries, Inc., Tokyo (JP)

( * ) Notice: Subject to any disclaimer, the term of this patent is extended or adjusted under 35 U.S.C. 154(b) by 1032 days.

(21) Appl. No.: 16/975,435

(22) PCT Filed: Mar. 5, 2019

(86) PCT No.: PCT/JP2019/008615

§ 371 (c)(1),
(2) Date: Aug. 25, 2020

(87) PCT Pub. No.: WO2019/172246

PCT Pub. Date: Sep. 12, 2019

(65) Prior Publication Data

US 2021/0079563 A1 Mar. 18, 2021

(30) Foreign Application Priority Data

Mar. 6, 2018 (JP) ..... 2018-039722

(51) Int. Cl.
*D01F 9/22* (2006.01)

(52) U.S. Cl.
CPC ..... *D01F 9/22* (2013.01)

(58) Field of Classification Search
CPC ..... D01F 9/22
See application file for complete search history.

(56) References Cited

U.S. PATENT DOCUMENTS 5,356,707 A 10/1994 McCullough et al.
5,582,912 A * 12/1996 McCullough, Jr. ..... D02G 1/14 428/362

(Continued)

FOREIGN PATENT DOCUMENTS

JP 51-105419 9/1976
JP 58-087321 5/1983

(Continued)

OTHER PUBLICATIONS

Translation for JP 2015/067910. (Year: 2015).*

(Continued)

*Primary Examiner* — Peter Y Choi
(74) *Attorney, Agent, or Firm* — DLA Piper LLP (US)

(57) ABSTRACT

A carbon fiber includes single fibers having lengths of 10 cm or less, a fiber axis of each single fiber having an undulation width of 2.5 μm or more when a part thereof between two points with a straight-line distance of 1 mm is observed from a lateral direction, and a coefficient of variation in the undulation width being 100% or less. A method of producing carbon fiber production includes performing stabilization treatment of a precursor fiber bundle for polyacrylonitrile based carbon fiber, performing pre-carbonization treatment, and performing carbonization treatment in this order, followed by cutting the resulting carbon fiber bundle in the form of continuous fiber to a single fiber length of 10 cm or less, the twist count of the fiber bundle during the carbonization treatment step being 16 turns/m or more.

7 Claims, 1 Drawing Sheet

(56) References Cited

U.S. PATENT DOCUMENTS

| | | | | |
|---|---|---|---|---|
| 2007/0193246 | A1 | 8/2007 | Schneider | |
| 2018/0051399 | A1* | 2/2018 | Suzuki | D01F 9/225 |

FOREIGN PATENT DOCUMENTS

| | | |
|---|---|---|
| JP | 8-507336 | 8/1996 |
| JP | 2001-279537 | 10/2001 |
| JP | 2002-001725 | 1/2002 |
| JP | 2008-509298 | 3/2008 |
| JP | 2014-141761 | 8/2014 |
| JP | 2015-067910 | 4/2015 |
| JP | 2006-70153 | 3/2016 |
| WO | 2014-196432 | 12/2014 |

OTHER PUBLICATIONS

Tsai, Jin-Shy, "Tension of Carbonization of Carbon Fiber," Polymer Engineering and Science, Mid-Oct. 1994, vol. 34, No. 19, pp. 1480-1484.

* cited by examiner

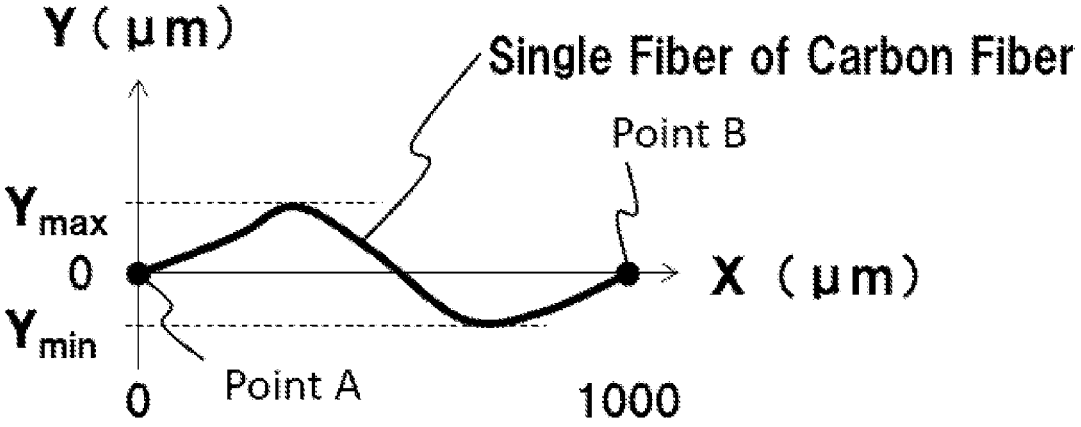
Y (μm)
Single Fiber of Carbon Fiber
Point B
Ymax
0
Ymin
X (μm)
0
Point A
1000

CARBON FIBER AND METHOD OF MANUFACTURING SAME

TECHNICAL FIELD

This disclosure relates to a carbon fiber in which the fiber axis is undulated in a specific form and a method of production thereof.

BACKGROUND

High in specific strength and specific modulus, carbon fibers serve to produce members having drastically reduced weight when used as reinforcing fiber for fiber reinforced composite materials and, accordingly, it is used in a wide range of fields as an indispensable material for realizing a society with high energy utilization efficiency. Recently, it has also been in wider use in some fields characterized by strong cost consciousness such as production of automobiles and housing of electronic instruments, and there are strong demands for techniques to realize a reduction in the final cost for member production including the molding cost. In such circumstances, carbon fibers are now attracting attention not only as conventional continuous fiber material, but also as discontinuous fiber material having high moldability and shapeability. However, conventional chopped carbon fibers and milled carbon fibers produced by cutting and pulverizing to a constant length are not necessarily designed exclusively as discontinuous fibers and, in the future, it is anticipated that the development of carbon fibers intended for utilization as discontinuous fibers will increase in importance.

One of the important properties in utilizing as discontinuous fibers is the dispersibility in a matrix. Hereinafter, the dispersibility in a matrix is occasionally referred simply as the dispersibility. When having a high dispersibility, single fibers can spread uniformly and hopefully provide high handleability during a processing of producing carbon fiber reinforced composite materials or realize the manufacturing of final products having uniform property distribution. As a technique to enhance the dispersibility, crimping has been widely performed in the field of synthetic fibers. As one of the effects of crimping, it is known that undulation of the fiber axis occurs to prevent the single fibers from undergoing stacking (i.e., aggregation of their bundles) in the matrix, thus ensuring increased bulkiness. In other words, they are easily dispersed separately and uniformly.

Whereas the production of carbon fiber is often performed under tension in the carbonization step, fiber bundles will shrink if the carbonization step is carried out without tension, sometimes resulting in a crimped carbon fiber. A carbon fiber produced under such tension-free conditions tends to be lower in tensile modulus.

Other examples of proposals include a techniques to perform stabilization, pre-carbonization, and carbonization of a twisted precursor fiber bundle for polyacrylonitrile based carbon fiber for the purpose of enhancing the processability and productivity in a stabilization step (Japanese Unexamined Patent Publication (Kokai) No. SHO-58-087321), although no attention is paid to the undulation of the fiber axis, and a technique to carbonize a twisted fiber bundle under high tension for the purpose of obtaining carbon fiber with increased strand elastic modulus (Japanese Unexamined Patent Publication (Kokai) No. 2014-141761). Furthermore, there are still other proposals including a technique to produce wire made of a carbon fiber by twisting a carbon fiber bundle and impregnating it with a matrix resin (International Publication WO 2014/196432), a technique to produce a molded article by a similar process (Japanese Unexamined Patent Publication (Kokai) No. 2006-70153), a technique to produce a sewing thread from a twisted carbon fiber bundle (Published Japanese Translation of PCT International Publication JP 2008-509298), and a technique to wind up a carbon fiber in a twisted state (Japanese Unexamined Patent Publication (Kokai) No. 2002-001725).

The techniques described above, however, have problems.

In Japanese Unexamined Patent Publication (Kokai) No. SHO-58-087321 and Japanese Unexamined Patent Publication (Kokai) No. 2014-141761, although there is a possibility that a permanently twisted carbon fiber bundle is obtained by carbonizing it in a twisted state, the proposals are limited mainly to enhancing the processability in the stabilization step and applying a high tension in the carbonization step to obtain a carbon fiber that contains single fibers with high elastic modulus, and the resulting carbon fiber does not always have a required degree of single fiber undulation.

International Publication WO 2014/196432, Japanese Unexamined Patent Publication (Kokai) No. 2006-70153 and Published Japanese Translation of PCT International Publication JP 2008-509298 relate to utilization methods to provide a twisted carbon fiber, which apparently maintains the twist in their utilization form, but the twist is only a provisional one that is maintained forcibly. For a carbon fiber, which dominantly undergoes elastic deformation and hardly undergoes plastic deformation, therefore, the degree of undulation of single fibers, once released from the twist, will decrease to near that of the original carbon fiber material.

Specifically, although there are several proposed techniques to produce a final product containing a twisted carbon fiber bundle or impart a twisted shape to a fiber bundle during the manufacturing process, they do not give any ideas or suggestions regarding the presence of undulation of the fiber axis at a single fiber level or the role of such undulation to enhance the dispersibility of the carbon fiber, and their effects are not noticeable. Thus, the development of carbon fibers having high dispersibility and suitable for use as discontinuous fibers is an essential issue.

SUMMARY

We thus provide a carbon fiber containing single fibers having lengths of 10 cm or less, the fiber axis of each single fiber having an undulation width of 2.5 μm or more when a part thereof between two points with a straight-line distance of 1 mm is observed from a lateral direction, and the coefficient of variation in the undulation width being 100% or less.

The carbon fiber can meet formula (1), wherein $L_c$ is the average crystallite size and $\pi_{002}$ is the average orientation parameter of crystallites of the single fibers.

$$\pi_{002}(s) \geq 4.0 \times L_c(s) + 73.2 \quad (1)$$

The carbon fiber can contain single fibers having diameters of 3.0 μm or more.

The carbon fiber can contain single fibers having diameters of 6.1 μm or more.

The carbon fiber can contain single fibers having elastic modulus of 200 GPa or more.

The carbon fiber production method includes steps of performing stabilization treatment of a precursor fiber bundle for polyacrylonitrile based carbon fiber, performing pre-carbonization treatment, and performing carbonization treatment in this order, followed by cutting the resulting carbon fiber bundle, the twist count of the fiber bundle during the carbonization step being 16 turns/m or more or the twist angle of the surface of the fiber bundle being 2.0° or more.

The carbon fiber has the morphological feature that the fiber axis is undulated in a specific range, which is a feature that cannot be seen in the other existing carbon fibers. Since this undulated form prevents the single fibers from undergoing aggregation while in the form of bundles, the carbon fiber exhibits high dispersibility during the molding process of producing a carbon fiber reinforced composite material or in the final molded article, hopefully leading to a reduction in the processing cost and an improvement in mechanical characteristics of carbon fiber reinforced composite materials.

BRIEF DESCRIPTION OF THE DRAWING

The FIGURE is a schematic view showing the method of measuring the undulation width of the fiber axis.

DETAILED DESCRIPTION

In descriptions regarding material properties, both a single fiber of carbon fiber and an aggregate thereof are occasionally referred to as carbon fiber without distinction. For the carbon fiber, such aggregates of single fibers may be in various forms such as bundle, web, and combinations thereof. The production method of the carbon fiber will be described later.

In the carbon fiber, the fiber axis of a single fiber has an undulation width of 2.5 μm or more when a part of the single fiber between two points with a straight-line distance of 1 mm is observed from a lateral direction. Measurement of the undulation width is performed by observing a single fiber of carbon fiber from a direction perpendicular to the fiber axial direction in an environment in which no stress other than gravity exits. For a fiber having a three dimensional fluctuation, the fiber axis direction and the perpendicular direction thereto are defined as follows. When a single fiber of carbon fiber remains stationary on a horizontal surface, a straight line connecting two points separated by 1,000 μm on the projection image to the horizontal surface is defined as a virtual fiber axis of the section being observed, and the vertical direction is defined as the perpendicular direction to the fiber axis direction. Thus, the undulation width is an approximate value that is determined in the projected image. In a carbon fiber used as a reinforcing material for a discontinuous fiber reinforced composite material and contained in a molded article, a discontinuous fiber mat, an intermediate such as web, or pellets intended for injection molding, carbon fiber samples are first taken out and then examined. Depending on the type of the matrix used, known useful methods for taking them out include, for example, removal of the matrix with a solvent and thermal degradation of the matrix by heating it in an air atmosphere at a temperature equal to or higher than the thermal degradation temperature of the matrix (generally around 500° C. for organic polymers) for about 2 hours. As shown in the FIGURE, wherein point A is an appropriately selected through-thickness center of the single fiber being observed and assumed to be the origin of the XY coordinate plane located at the position where X=0 μm and Y=0 whereas point B is another through-thickness center of the single fiber 1 mm straight away therefrom and assumed to be on the X axis at the position where X=0 μm and Y=1,000 the undulation width is defined as the difference ΔY (μm) between the highest through-thickness center of the single fiber in the Y-axis direction located at $Y_{max}$ (μm) and the lowest one located at $Y_{min}$ (μm), which is calculated by subtracting the latter from the former. Ten independent single fibers are randomly selected and subjected to undulation width measurement, and their average value is adopted. We believe that no particular attention has been paid in the conventional technology for carbon fibers to the presence of a preferred range of undulation width and the usefulness of controlling it, but we found that, when they are used in the form of discontinuous fibers, as the undulation width increases, it becomes more difficult for neighboring single fibers to be stacked in parallel (that is, more difficult to be aggregated to form a single fiber bundle), or rather, they can form highly dispersible aggregates of single fibers. According to our measurements, most commercially available carbon fibers had undulation widths of less than 2 μm or 1 μm or less. The undulation width is preferably 3 μm or more, more preferably 4 μm or more, and still more preferably 5 μm or more. From the viewpoint of dispersibility, the upper limit of the undulation width is not particularly limited, but from the viewpoint of manufacturing processes for producing carbon fibers, the upper limit is generally about 500 The undulation width can be controlled by imparting undulation to the fiber bundle in the step for stabilization, the step for pre-carbonization, or the step for carbonization, which will be described later. In particular, from the viewpoint of easiness of imparting undulation, it is preferable to impart undulation to the fiber bundle in the carbonization step, which is performed at the highest treatment temperature. Useful methods of imparting undulation include generally known ones including twisting fiber bundles and knitting fiber bundles by a braiding technique into a form of a three plait braid or a four plait braid. From an industrial viewpoint, in particular, it is preferable to employ the twisting technique, which requires only a simple facility. Furthermore, we found that use of single fibers having larger diameters serves effectively to enhance the undulation width.

The carbon fiber has a coefficient of variation in the undulation width of 100% or less. The coefficient of variation in the undulation width is calculated by the following formula using the standard deviation determined from data obtained by taking measurements from randomly selected 10 independent single fibers.

$$CV\ (\%) = \text{standard deviation of undulation width } (\mu m) / \text{average undulation width } (\mu m) \times 100 (\%)$$

As the coefficient of variation in the undulation width decreases, the variation in the degree of fiber axis undulation among single fibers decreases, serving to prevent the range of density in fiber arrangement from increasing due to differences in undulation encountered when handling aggregates of single fibers. As a result, it is easy to form a uniform dispersion state when they are dispersed in a matrix. It is preferable for the coefficient of variation in the undulation width to be 80% or less. Whereas the degree of undulation may vary largely among the single fibers if fiber axis undulation is introduced by allowing them to undergo free shrinking in the carbonization step, the coefficient of variation in the undulation width tends to be low if undulation is imparted to the fiber bundle in the step of stabilization, pre-carbonization, or carbonization, which will be described later. Thus, it is preferable that the coefficient of variation in the undulation width is minimized, although about 30% to 40% will be a substantial lower limit.

The carbon fiber has single fiber lengths of 10 cm or less. A fiber length of 10 cm or less means that the carbon fiber will be utilized as discontinuous fibers. There are a variety of forms of utilization of discontinuous fibers, ranging from sheet molding compounds (SMCs), in which fibers have relatively long lengths, to injection molding materials, in which fibers have short lengths, but the fiber length is generally about 10 cm or less regardless of the form of utilization. The fiber length of single fibers refers not only to the fiber length resulting from intentional cutting, but also to the length of fibers left after the molding step. The shorter the fiber length of the single fibers, the higher the moldability and shapeability in the steps of processing into a carbon fiber reinforced composite material, which is preferable from the viewpoint of reducing the cost of the final product including the molding cost. A carbon fiber can serve excellently when the fiber length of the single fibers is 10 cm or less and the undulation width is within the above range, thereby leading to highly dispersible aggregates of single fibers. Furthermore, it is preferable for single fibers having a single fiber length of 1 mm or more and 10 cm or less account for 90% to 100% by mass. The method of realizing a fiber length in a predetermined range will be described later.

It is preferable for the carbon fiber to meet formula (1), wherein $L_c$ (s) is the average crystallite size of the single fibers and $\pi_{002}$ (s) is the average orientation parameter of crystallites.

$$\pi_{002}(s) \geq 4.0 \times L_c(s) + 73.2 \quad (1)$$

The crystallite size $L_c$ and the orientation parameter of crystallites $\pi_{002}$ are indicators of the thickness in the c-axis direction of the crystallites present in the carbon fiber and the orientation angle with respect to the fiber axis of the crystallite. They are usually determined from wide-angle X-ray diffraction patterns of fiber bundles, but each of three single fibers is observed separately by microbeam wide-angle X-ray diffraction, and the measurements taken from the three single fibers are averaged and adopted to represent the average crystallite size $L_c$ (s) and average orientation parameter of crystallites $\pi_{002}$ (s). Measurements are taken just as described above when the size of the microbeam is larger than the diameter of the single fibers, but when the size of the microbeam is equal to or smaller than the diameter of the single fibers, the average crystallite size $L_c$ (s) and the average orientation parameter of crystallites $\pi_{002}$ (s) are determined by taking measurements at a plurality of points aligned in the diameter direction of a single fiber and averaging them to represent that single fiber, followed by repeating this procedure to obtain measurements from a total of three single fibers, which are averaged and adopted. A detailed measuring procedure will be described later. In general, as the crystallite size $L_c$ increases, the adhesive strength between the carbon fiber and the matrix tends to decrease, whereas as the orientation parameter of crystallites $\pi_{002}$ increases, the elastic modulus of the single fibers of the carbon fiber tends to become higher and, accordingly, raising the orientation parameter of crystallites $\pi_{002}$ relative to the crystallite size $L_c$ makes it possible to enhance the elastic modulus of the single fibers effectively while suppressing the decrease in the adhesive strength. Our measurements show that for the single fibers contained in commercially available carbon fiber bundles, the relationship between the average crystallite size $L_c$ (s) and the average orientation parameter of crystallites $\pi_{002}$ (s) was approximately as represent by the following formula: $4.0 \times L_c(s) + 71.0 < \pi_{002}(s) < 4.0 \times L_c(s) + 73.0$. If the average crystallite size $L_c$ (s) and the average orientation parameter of crystallites $\pi_{002}$ (s) of the single fibers meet formula (1), a high adhesive strength and a high elastic modulus of the single fibers can be realized simultaneously. The relationship represented by formula (1) is more preferably $\pi_{002}(s) > 4.0 \times L_c(s) + 73.2$, still more preferably $\pi_{002}(s) > 4.0 \times L_c(s) + 73.8$, and particularly preferably $\pi_{002}(s) > 4.0 \times L_c(s) + 74.4$. A carbon fiber that meets formula (1) can be produced by increasing the stretching tension in the step for carbonization.

It is preferable for the carbon fiber to meet formula (2), wherein $L_c$ (s) is the average crystallite size of the single fibers and $\pi_{002}$ (s) is the average orientation parameter of crystallites.

$$\pi_{002}(s) \leq 3.1 \times L_c(s) + 81.8 \quad (2)$$

The orientation parameter of crystallites $\pi_{002}$ can be increased relative to the crystallite size $L_c$ by increasing the stretching tension in the step for carbonization, but if the stretching tension is too high, generation of fuzz and breakage of fiber bundles may occur to cause deterioration in the stability of the entire process, which means that there is a suitable range of stretching tension. Controlling the stretching tension to meet formula (2) prevents the generation of fuzz and breakage of fiber bundles from causing significant problems. A carbon fiber that meets formula (2) can be produced by controlling the stretching tension in the step for carbonization.

The average crystallite size $L_c$ (s) of the single fibers is preferably 1.7 to 8 nm, more preferably 1.7 to 3.8 nm, still more preferably 2.0 to 3.2 nm, and particularly preferably 2.3 to 3.0 nm. A large crystallite size $L_c$ serves to realize effective stress bearing inside the carbon fiber to permit easy enhancement of the elastic modulus of the single fibers, but if the crystallite size $L_c$ (s) is too large, stress concentration can occur to cause a decrease in the tensile strength, compressive strength and the like, of the single fibers and, therefore, an appropriate value should be determined on the basis of the balance among the required elastic modulus of the single fibers, tensile strength of the single fibers, and compressive strength. The crystallite size $L_c$ (s) can be controlled mainly by changing the treatment periods and maximum temperatures in and after the carbonization step.

Furthermore, the average orientation parameter of crystallites $\pi_{002}$ (s) of the single fibers is preferably 80% to 95%, more preferably 80% to 90%, and still more preferably 82% to 90%. The average orientation parameter of crystallites $\pi_{002}$ (s) can be controlled by changing the stretching tension as well as the temperature and time period in the carbonization step.

The diameter of the single fibers is preferably 3.0 μm or more, more preferably 4.5 μm or more, still more preferably 6.1 μm or more, still more preferably 6.5 μm or more, and particularly preferably 6.9 μm or more. The diameter of a single fiber is measured by observing a cross-sectional of the fiber by scanning electron microscopy. If the observed cross section of a single fiber is not a perfect circle, the circle equivalent diameter is adopted to represent it. The circle equivalent diameter refers to the diameter of a perfect circle having an area that is equal to the actually measured cross-sectional area of the single fiber. A larger diameter of the single fiber is expected to realize not only a higher productivity in carbon fiber production, but also an improvement in the moldability in the process of producing carbon fiber reinforced composite materials and suppression of fiber breakage during higher order processing steps. In addition, we found that a single fiber having a larger single fiber diameter can be easily undulated to a higher degree. The effect described above can be realized to a required level if the diameter of the single fibers is 3.0 μm or more. Although there is no particular upper limit on the diameter of the single fibers, it is practically about 15 μm. The diameter of the single fibers can be controlled by adjusting the rate of discharge through the spinneret during the yarn making process for a precursor fiber bundle for polyacrylonitrile based for carbon fiber and the total draw ratio in the process from the discharge through the spinneret until the completion of carbon fiber production.

The single fibers preferably have an elastic modulus of 200 GPa. The elastic modulus of the single fibers is more preferably 240 GPa or more, still more preferably 260 GPa or more, still more preferably 320 GPa or more, and still more preferably 340 GPa or more. If the single fibers have a high elastic modulus, they serve for easy production of a final carbon fiber reinforced composite material having a high rigidity, and the elastic modulus of single fibers is calculated on the basis of analysis of a stress-strain curve observed in tensile test of the single fibers. Elastic modulus of single fibers shows a positive correlation with the elastic modulus of resin-impregnated strands measured according to JIS R7608 (2004). Therefore, single fibers having a higher elastic modulus serve for easy production of carbon fiber reinforced composite materials having higher rigidity, which have higher industrial usefulness in applications in which weight reduction of members is an important issue. The elastic modulus of single fibers is determined based on samples of single fibers with different fiber lengths subjected to the same test to eliminate the influence of the instrumental compliance. The method of producing a carbon fiber containing single fibers having an elastic modulus of 200 GPa or more will be described later.

The production method of the carbon fiber is described below.

A precursor fiber bundle for polyacrylonitrile based carbon fiber serving as material for producing the carbon fiber can be prepared by spinning a spinning solution of a polyacrylonitrile copolymer.

Examples of the polyacrylonitrile copolymer include not only homopolymers produced only from acrylonitrile, but also copolymers produced from a combination of an acrylonitrile adopted as main component and another monomer, and mixtures thereof. More specifically, the polyacrylonitrile copolymer preferably contains 90% to 100% by mass of a structure derived from acrylonitrile and less than 10% by mass of a structure derived from a copolymerizable monomer.

Useful monomers that are copolymerizable with acrylonitrile include, for example, acrylic acid, methacrylic acid, itaconic acid, and alkali metal salts thereof ammonium salts and lower alkyl esters; acrylamide and derivatives thereof; and allyl sulfonic acid, methacrylic sulfonic acid, and salts or alkyl esters thereof.

The polyacrylonitrile copolymer described above is dissolved in a solvent in which the polyacrylonitrile copolymer is soluble such as dimethyl sulfoxide, dimethylformamide, dimethylacetamide, nitric acid, aqueous zinc chloride solution, and aqueous sodium rhodanide solution, to prepare a spinning solution. If the solution polymerization technique is used to produce the polyacrylonitrile copolymer, it is preferable that the solvent used for polymerization is the same as the solvent used for spinning because in that situation, it is possible to eliminate steps of separating the resulting polyacrylonitrile copolymer and redissolving it in a solvent to use for spinning.

A precursor fiber bundle for polyacrylonitrile based carbon fiber can be produced by spinning the spinning solution prepared as described above by the wet spinning method or the dry-jet wet spinning method.

More specifically, a precursor fiber bundle for polyacrylonitrile based carbon fiber can be produced by introducing the spinning solution prepared as described above into a coagulation bath in which it is coagulated, and subjecting the resulting coagulated fiber bundle to a water washing step, an in-bath stretching step, an oil agent treatment step, and a drying step. The water washing step may be omitted so that the coagulated fiber bundle is subjected directly to the in-bath stretching step, or the in-bath stretching step may be performed after removing the solvent by the water washing step. In general, it is preferable for the in-bath stretching step to be carried out in a single or a plurality of stretching baths controlled at a temperature of 30° C. to 98° C. Furthermore, a dry heat stretching step or a steam stretching step may be added to the above steps.

It is preferable for the single fibers contained in the precursor fiber bundle for polyacrylonitrile based carbon fiber to have an average fineness of 0.8 dtex or more, more preferably 0.9 dtex or more, still more preferably 1.0 dtex or more, and particularly preferably 1.1 dtex or more. If the single fibers in the precursor fiber bundle for polyacrylonitrile based carbon fiber has an average fineness of 0.8 dtex or more, fuzz generation due to contact with rollers or guide parts is suppressed and the process stability in the steps for yarn making, carbon fiber stabilization, pre-carbonization, and carbonization can be maintained easily. From this point of view, the average fineness of the single fibers in the precursor fiber bundle for polyacrylonitrile based carbon fiber should be as high as possible. If the average fineness of the single fibers in the precursor fiber bundle for polyacrylonitrile based carbon fiber is too high, it will be difficult to perform uniform treatment in the stabilization step in some instances, possibly leading to an unstable manufacturing process or resulting in a carbon fiber bundle and carbon fiber with deteriorated mechanical characteristics. From this point of view, the average fineness of the single fibers in the precursor fiber bundle is preferably 2.0 dtex or less. The average fineness of the single fibers in the precursor fiber bundle for polyacrylonitrile based carbon fiber can be controlled by a generally known method such as adjusting the discharge rate of the spinning solution from the spinneret or the stretching ratio.

The resulting precursor fiber bundle for polyacrylonitrile based carbon fiber is usually in the form of continuous fibers. It is preferable for the fiber bundle to contain 1,000 or more filaments. As the filament number increases, the productivity can be enhanced more easily. Although there is no clear upper limit on the filament number in the precursor fiber bundle for polyacrylonitrile based carbon fiber, it is commonly about 250,000.

A carbon fiber bundle in the form continuous fibers to be used to produce the carbon fiber can be prepared by subjecting the aforementioned precursor fiber bundle for polyacrylonitrile based carbon fiber to a stabilization step, pre-carbonization step, and carbonization step in this order. The steps of performing these treatments will be occasionally referred to as the stabilization step, pre-carbonization step, and carbonization step.

The stabilization of the precursor fiber bundle for polyacrylonitrile based carbon fiber is preferably performed in an air atmosphere in the temperature of 200° C. to 300° C.

The stabilization step is followed by the pre-carbonization step. In the pre-carbonization step, it is preferable for the resulting stabilized fiber bundle to be subjected to heat treatment in an inactive atmosphere at or below a maximum temperature of 500° C. to 1,000° C. until the density reaches 1.5 to 1.8 g/cm$^3$.

Furthermore, the pre-carbonization described above is followed by carbonization. In the carbonization step, it is preferable for the resulting pre-carbonized fiber bundle to be subjected to heat treatment in an inactive atmosphere at or below a maximum temperature of 1,000° C. to 3,000° C. The maximum temperature in the carbonization step is preferably as high as possible from the viewpoint of obtaining carbon fiber containing single fibers having a high elastic modulus, but since an excessively high temperature can result in a decrease in the strength of adhesion between the carbon fiber and the matrix, it is preferable to set an appropriate temperature on the basis of this trade-off relation. For the above reason, the maximum temperature in the carbonization step is more preferably 1,400° C. to 2,500° C. and still more preferably 1,700° C. to 2,000° C.

A carbon fiber bundle to be used to produce the carbon fiber is obtained by setting the twist count of the fiber bundle in the carbonization step to 16 turns/m or more. This twist count is preferably 16 to 120 turns/m, more preferably 16 to 80 turns/m, and still more preferably 16 to 45 turns/m. Controlling the twist count in the above range produces a carbon fiber in which the fiber axis of each single fiber present in the resulting carbon fiber bundle is undulated in a specific form to realize a high dispersibility. Although there is no particular limitation on the upper limit on the twist count, it is preferable to set a temporary upper limit to about 500 turns/m to avoid complication of the twisting step. The twist count can be controlled by a method in which the precursor fiber bundle for polyacrylonitrile based carbon fiber, stabilized fiber bundle, or pre-carbonized fiber bundle is once wound up on a bobbin, followed by unwinding the fiber bundle while rotating the bobbin in the plane perpendicular to the unwinding direction, or by a method in which, instead of winding up the traveling fiber bundle on a bobbin, a rotating roller or belt is brought into contact with it to impart twists.

A carbon fiber bundle to be used to produce the carbon fiber is produced by setting the twist angle of the surface of the fiber bundle 2.0° or more in the carbonization step. This twist angle is preferably 2.0° to 41.5°, more preferably 2.0° to 30.5°, and still more preferably 2.0° to 20.0°. Controlling the twist angle in the above range produces a carbon fiber in which the fiber axis of each single fiber present in the resulting carbon fiber bundle is undulated in a specific form to realize a high dispersibility. Although there is no particular limitation on the upper limit of the twist angle, it is preferable to set a temporary upper limit to about 52.5° to avoid complication of the twisting step. The twist angle can be controlled by a method in which the precursor fiber bundle for polyacrylonitrile based carbon fiber, stabilized fiber bundle, or pre-carbonized fiber bundle is once wound up on a bobbin, followed by unwinding the fiber bundle while rotating the bobbin in the plane perpendicular to the unwinding direction, or by a method in which, instead of winding up the traveling fiber bundle on a bobbin, a rotating roller or belt is brought into contact with it to impart twists. The twist angle of the surface layer of the fiber bundle can be calculated as described later from the twist count of the fiber bundle, the filament number, and the diameter of the single fiber.

Furthermore, the tension in the carbonization step may be set as desired within a range where a carbon fiber bundle is produced stably, but it is preferably 1 to 18 mN/dtex, more preferably 1.5 to 18 mN/dtex, still more preferably 3 to 18 mN/dtex, and still more preferably 5 to 18 mN/dtex. The tension in the carbonization step is calculated by dividing the tension (mN) measured at the outlet of the carbonization furnace by the total fineness (dtex), which is the product of the average fineness (dtex) of the single fibers and the filament number in the precursor fiber bundle for polyacrylonitrile based carbon fiber used here. By controlling the tension, it is possible to control the average orientation parameter of crystallites $\pi_{002}$ (s) to produce a carbon fiber that meets formula (1) without significantly affecting the average crystallite size $L_c$ (s) of the resulting carbon fiber. The tension is preferably as high as possible from the viewpoint of providing a carbon fiber that contains single fibers having a high elastic modulus, but an excessively high tension can lead to a decrease in processability or resulting in a carbon fiber having poor quality and, therefore, both of them should be taken into account when setting it. If the tension in the carbonization step is increased without imparting twists, breakage of single fibers can occur in the fiber bundle and fuzz formation can be accelerated to cause a decrease in the processability in the carbonization step or breakage of the entire fiber bundle, possibly leading to a failure in maintaining a required tension, whereas if the fiber bundle is twisted in the carbonization step, fuzz formation is suppressed to ensure a high tension.

The filament number in the fiber bundle being treated in the carbonization step is preferably 10,000 or more, more preferably 15,000 or more, and still more preferably 20,000 or more. If assuming fiber bundles that have the same twist count during the carbonization step, the distance between the central axis of twists and the outer periphery in each fiber bundle increases with an increasing filament number, thereby enhancing the aforementioned effect of the twists to permit the production of a carbon fiber with higher dispersibility. As another effect, furthermore, it is easier to control fuzz generation and fiber breakage in the carbonization step even when applying a high tension, thus effectively making it possible to produce a carbon fiber containing single fibers with highly increased elastic modulus. The filament number in the fiber bundle being treated in the carbonization step can be calculated from the density and metsuke of the fiber bundle and the average diameter of the single fibers. Although there is no particular limitation on the upper limit of the number of these filaments and it may be set appropriately depending on the intended use, the upper limit is generally about 250,000 in view of requirements of the production process to provide carbon fiber.

Good examples of the inert gas used for the inert atmosphere include nitrogen, argon, and xenon, of which nitrogen is preferred from an economic point of view.

The carbon fiber bundle in the form of a continuous fiber obtained as described above may be subjected to surface treatment to introduce a functional group containing an oxygen atom, thereby ensuring an improved adhesive strength between the carbon fiber and the matrix. Useful surface treatment methods include gas phase oxidization, liquid phase oxidization, and liquid phase electrolytic oxidization, of which liquid phase electrolytic oxidization has been preferred from the viewpoint of high productivity and uniform treatment. There are no specific limitations on the technique to be used for liquid phase electrolytic oxidation and a generally known one may be selected appropriately.

After such electrolytic treatment, a sizing agent may be attached to the carbon fiber bundle obtained, which is in the form of continuous fiber to further enhance the handleability and higher order processability or to ensure improved adhesive strength between the carbon fiber and the matrix. A suitable sizing agent may be selected appropriately taking into consideration the type of matrix resin to be used in the carbon fiber reinforced composite material. In addition, the degree of its deposition may be finely adjusted to realize improved handleability and higher order processability. Furthermore, deposition of the sizing agent may be minimized or the sizing treatment may be omitted when there is concern that a decrease in the adhesive strength between the carbon fiber and the matrix may be caused by a pyrolysate of the sizing agent, for example as a result of using a matrix that requires a high molding temperature.

Then, the carbon fiber is obtained by cutting the resulting carbon fiber bundle in the form of continuous fiber in such a manner that the fiber length of the single fibers is 10 cm or less. As regards the cutting method to use, an appropriate one may be selected from among generally known cutting methods to meet operator's tastes or purposes and examples include cutting the fiber bundle with scissors, knife or the like, destroying it by a pulling force caused between rollers moving at different speeds or by other means of applying tension, and cutting it by a screw or gear of an extruder.

The methods used to measure the various physical values mentioned herein are described below. Undulation width and coefficient of variation in undulation width of fiber axis in carbon fiber A single fiber of the carbon fiber to be examined is cut to 1 to 5 mm in length and placed on a copy paper laid on a horizontal table. If the single fiber adheres to the copy paper due to the influence of static electricity, the static charge is removed by a common technique before taking measurements. It is observed under an optical microscope from the vertical direction to the paper surface, and the image is taken. For the optical microscope, an objective lens with a magnification of 10 times is used. The image is stored in jpg format, horizontal 2,592 pixels×vertical 1,944 pixels. At this time, the area for observation is defined so that when a scale having an actual length of 1,000 μm is photographed, the scale is 2,320 to 2,340 pixel long in the image. The image file thus obtained is opened by ImageJ, an open-source image processing program, followed by setting point A at an appropriately position on the fiber axis and point B at a position 1,000 μm away from point A on the fiber axis. Then, Bilinear Interpolation is selected as interpolation algorithm for image rotation, and the image is rotated so that point A and point B is on a horizontal line. The image data are binarized and then skeletonized to extract the fiber axis as a 1-pixel-wide curve. At this time, the fiber axis may be branched due to dust and the like adhered to the fiber surface, but such branches other than the fiber axis are ignored. Finally, for the section of the fiber axis between point A and point B, the difference ΔY (μm) on the Y-axis between the highest point at $Y_{max}$ (μm) and the lowest point at $Y_{min}$ (μm) is read to represent the undulation width of the single fiber. Undulation width measurements are taken from 10 independent single fibers, and they are averaged and adopted as the undulation width. Furthermore, the coefficient of variation in the undulation width is calculated by the following formula using the standard deviation determined from the measurements taken from 10 independent single fibers.

$$CV\ (\%) = \text{standard deviation of undulation width } (\mu m)/\text{average undulation width } (\mu m) \times 100(\%)$$

An upright microscope (DM2700M, manufactured by Leica Microsystems) was used as the optical microscope in the examples given below.

Average Crystallite Size $L_c$(s) and Average Orientation Parameter of Crystallites $\pi_{002}$(s) of Single Fiber of Carbon Fiber A single fiber of carbon fiber is observed by wide-angle X-ray diffraction using a diffractometer in which X-ray μ beam is available. Observation is performed using a micro-beam with a wavelength of 1.305 Angstroms, which has a trimmed shape of 3 μm in the fiber axis direction and 1 μm in the fiber diameter direction, while scanning the single fiber in 1 μm steps in the fiber diameter direction. The irradiation time is 2 seconds per step. The camera length, which is the distance between the detector and the sample, is set in the range of 40 to 200 mm. The camera length and the coordinates of the beam center are determined using cerium oxide as standard sample. A two-dimensional diffraction pattern taken after removing the sample was subtracted from the two-dimensional diffraction pattern detected above to remove the dark noise coming from the detector and air-derived scattering noise, thereby providing a corrected two dimensional diffraction pattern. The corrected two-dimensional diffraction patterns determined at the various positions in the fiber diameter direction of the single fiber are added together to provide an averaged two-dimensional diffraction pattern in the fiber diameter direction of the single fiber. In this averaged two-dimensional diffraction pattern, a fan-shaped integration is performed for an angle range of ±5° around a direction perpendicular to the fiber axis to provide a diffraction intensity profile in the 2θ direction. The diffraction intensity profile in the 2θ direction is least-squares fitted using two Gaussian functions, followed by calculating $2\theta_m$(°), which is the 2θ value where the diffraction intensity is at a maximum, and FWHM (°), which represents the full width at half maximum of the composite function of the two Gaussian functions. Furthermore, azimuthal integration is performed over a range of ±5° around the angle of $2\theta_m$(°) where the diffraction intensity profile in the 2θ direction is at a maximum, thereby obtaining a diffraction intensity profile in the azimuthal direction. The diffraction intensity profile in the azimuthal direction is least-squares fitted using one Gaussian function to calculate the full width at half maximum FWHM β(°). The crystallite size $L_c$ and the orientation parameter of crystallites $\pi_{002}$ are calculated by the following formulae for three single fibers and their averages were calculated to obtain the average crystallite size $L_c$ (s) and the average crystallite size $\pi_{002}$ (s).

$$L_c(\text{nm}) = K\lambda/\text{FWHM}\cos(2\theta_m/2)$$

Scherrer factor K is 1.0 and the X-ray wavelength λ is 0.1305 nm. The full width at half maximum FWHM and $2\theta_m$ are used after converting their values in degrees (°) to values in radian (rad).

$$\pi_{002}(\%) = (180 - \text{FWHM}\beta)/180 \times 100(\%)$$

The full width at half maximum FWHM β is used after converting its value in degrees (°) to a value in radian (rad).

The equipment employed for the Examples include the second hatch of Beamline BLO3XU (FSBL) in SPring-8 used as X-ray μ-beam generator, and a C9827DK-10 flat panel detector (pixel size 50 μm×50 μm) (manufactured by Hamamatsu Photonics K.K.) used as detector.

Average Single Fiber Diameter of Carbon Fiber

A cross section of a single fiber of the carbon fiber under examination is observed by scanning electron microscopy to measure the cross-sectional area. The diameter of a true circle that has the same cross-sectional area as this cross-sectional area is calculated and adopted as the diameter of this single fiber. The acceleration voltage is set to 5 keV.

The scanning electron microscope employed for the Examples was an S-4800 scanning electron microscope (SEM) manufactured by Hitachi High-Tech Corporation.

Elastic Modulus of Single Fiber of Carbon Fiber

The elastic modulus of a single fiber of carbon fiber is determined according to HS R7606 (2000) as described below. First, a carbon fiber bundle of about 20 cm is divided into four approximately equal portions, and a single fiber is sampled from each of the four bundles in turn so that samples are collected as evenly as possible from all bundles. A single fiber sampled above is fixed on a piece of base paper having a hole of 10, 25, or 50 mm. An epoxy based adhesive (Araldite (registered trademark), Fast Curing Type, manufactured by Nichiban Co., Ltd.) is used for the fixation, and after bonding, it is allowed to stand at room temperature for 24 hours to ensure curing. Each piece of paper carrying a single fiber is mounted on a tensile test apparatus and tensile test is performed for each gauge length of 10, 25, or 50 mm under the conditions of a strain rate of 40%/min, and a total number of samples of 15. A stress (MPa)-strain (%) curve was prepared for each single fiber, and the apparent elastic modulus of the single fiber is calculated by the following equation from the slope (MPa/%) in the strain range of 0.3% to 0.7%.

Apparent elastic modulus (GPa) of single fiber=slope (MPa/%) in the strain range of 0.3%–0.7%/10

Then, for each of the gauge lengths 10, 25, and 50 mm, the average apparent elastic modulus $E_{app}$ (GPa) of single fibers is calculated and its reciprocal $1/E_{app}$ ($GPa^{-1}$) (longitudinal axis, Y axis) is plotted against the reciprocal $1/L_0$ ($mm^{-1}$) of the gauge length $L_0$ (mm) (horizontal axis, X axis). The Y-intercept in this plot is read and its reciprocal represents the compliance-corrected elastic modulus of the single fibers, which is adopted as the value of elastic modulus of single fibers.

A Tensilon RTF-1210 tensile tester manufactured by A&D Company, Limited was used as the tensile test device in the Examples.

Twist Angle of Surface Layer of Fiber Bundle

To determine the twist angle (°) of the surface layer of a fiber bundle during the carbonization step, the overall diameter of the fiber bundle is calculated by a formula given below from the twist count (turns/m) and the filament number of the fiber bundle being treated in the carbonization step, and the diameter (μm) of the single fibers in the resulting carbon fiber, and then the overall diameter of the fiber bundle is used to calculate the angle by another formula given below.

Overall diameter of fiber bundle (μm)={(diameter of single fiber)$^2$×filament number}$^{0.5}$ Remaining twist angle (°) of surface layer of fiber bundle=atan(overall diameter of fiber bundle×$10^{-6}$×π×number of remaining twists)

EXAMPLES

Examples will be described below, but this disclosure is not limited thereto.

Examples 1 to 18 and Comparative Examples 1 to 3 given below were performed by the procedure described in the following comprehensive example under the conditions described in Table 1.

Comprehensive Example

A monomer composition containing 99% by mass of acrylonitrile and 1% by mass of itaconic acid was polymerized by the solution polymerization method using dimethyl sulfoxide as solvent to prepare a spinning solution containing a polyacrylonitrile copolymer. The resulting spinning solution was subjected to a dry-jet wet spinning process in which it is filtered first, discharged in air through a spinneret, and then introduced into a coagulation bath containing an aqueous solution of dimethyl sulfoxide to produce a coagulated fiber bundle. Then, the coagulated fiber bundle was washed with water, stretched at a stretching ratio of 3 in a hot water bath at 90° C., treated with a silicone oil agent, dried by using a roller heated at a temperature of 160° C., and subjected to pressurized steam stretching at a stretching ratio of 4 to provide a precursor fiber bundle for polyacrylonitrile based carbon fiber having a single fiber fineness of 1.1 dtex. Subsequently, four such precursor fiber bundles for polyacrylonitrile based carbon fiber as prepared above were gathered so that the total number of single fibers would be 12,000, and heat-treated in an oven filled with air at temperature of 230° C. to 280° C. while maintaining a stretching ratio of 1 to achieve its conversion into stabilized fiber bundles.

Example 1

After producing stabilized fiber bundles by the procedure described in the comprehensive example, the resulting stabilized fiber bundles were subjected to a twisting step to impart twists of 100 turns/m and subjected to a pre-carbonization step at a stretching ratio of 0.97 in a nitrogen atmosphere at a temperature of 300° C. to 800° C., thereby providing pre-carbonized fiber bundles. Then, such pre-carbonized fiber bundles were subjected to a carbonization step under the conditions shown in Table 1 to provide carbon fiber bundles. The processability in the carbonization step was high, and the resulting carbon fiber bundles had good quality. The resulting carbon fiber bundles were cut with scissors to a single fiber length of 5 cm and examined to evaluate carbon fiber characteristics. Results are shown in Table 1.

Example 2

Except that the twist count was 75 turns/m, the same procedure as in Example 1 was carried out to prepare carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 3

Except that the twist count was 50 turns/m, the same procedure as in Example 1 was carried out to prepare carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 4

Except that the maximum temperature in the carbonization step was 1,900° C. and that the tension in the carbonization step was 3.5 mN/dtex, the same procedure as in Example 1 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 5

Except that the twist count was 75 turns/m, the same procedure as in Example 4 was carried out to prepare carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 6

Except that the twist count was 50 turns/m, the same procedure as in Example 4 was carried out to prepare carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 7

Except that the tension in the carbonization step was 6.9 mN/dtex, the same procedure as in Example 1 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 8

Except that the tension in the carbonization step was 8.2 mN/dtex, the same procedure as in Example 2 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 9

Except that the tension in the carbonization step was 7.8 mN/dtex, the same procedure as in Example 3 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 10

Except that the tension in the carbonization step was 5.4 mN/dtex, the same procedure as in Example 4 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 11

Except that the tension in the carbonization step was 6.1 mN/dtex, the same procedure as in Example 5 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 12

Except that the tension in the carbonization step was 5.2 mN/dtex, the same procedure as in Example 6 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table Example 13

Except that twists were imparted to pre-carbonized fiber bundles and that the tension in the carbonization step was 10.2 mN/dtex, the same procedure as in Example 12 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 14

Except that the procedure in the comprehensive example was modified so that the eight precursor fiber bundles were gathered to increase the number of single fibers to 24,000, the same procedure as in Example 5 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 15

Except that the tension in the carbonization step was 8.0 mN/dtex, the same procedure as in Example 14 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 16

Except that the twist count was 30 turns/m and that the tension in the carbonization step was 1.5 mN/dtex, the same procedure as in Example 4 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 17

Except that the twist count was 20 turns/m and that the tension in the carbonization step was 10.3 mN/dtex, the same procedure as in Example 16 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 18

Except that the procedure in the comprehensive example was modified so that the precursor fiber bundles had a single fiber fineness of 0.8 dtex, that the twist count was 45 turns/m, and that the tension in the carbonization step was 10.3 mN/dtex, the same procedure as in Example 1 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 19

Except that the twist count was 30 turns/m and that the tension in the carbonization step was 11.1 mN/dtex, the same procedure as in Example 14 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Example 20

Except that the twist count was 50 turns/m and that the tension in the carbonization step was 9.9 mN/dtex, the same procedure as in Example 14 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Comparative Example 1

Except that the twist count was 15 turns/m and that the tension in the carbonization step was 1.0 mN/dtex, the same procedure as in Example 1 was carried out to produce carbon fiber bundles and a carbon fiber having a single fiber length of 5 cm. The processability in the carbonization step was high, and the resulting carbon fiber bundles had good quality. Evaluation results of the resulting carbon fiber are given in Table 1.

Comparative Example 2

Except that the twist count was 0 turns/m and that the tension in the carbonization step was 7.5 mN/dtex, the same procedure as in Example 4 was carried out to produce carbon fiber bundles and a carbon fiber having a single fiber length of 5 cm. Fuzz was caught on the roller in the carbonization step, and the resulting carbon fiber bundles had poor quality. Evaluation results of the resulting carbon fiber are given in Table 1.

Comparative Example 3

Except that the twist count was 0 turns/m and that the tension in the carbonization step was 5.4 mN/dtex, the same procedure as in Example 1 was carried out to produce carbon fiber bundles and a carbon fiber having a single fiber length of 5 cm. Fuzz was caught on the roller in the carbonization step, and the resulting carbon fiber bundles had poor quality. Evaluation results of the resulting carbon fiber are given in Table 1.

Reference Example 1

Carbon fiber bundles of Torayca (registered trademark) T700S, manufactured by Toray Industries, Inc., were cut with scissors and single fibers (carbon fiber) were sampled and evaluated. Results are shown in Table 1. Prior to performing the evaluation, a procedure of immersing the carbon fiber bundle sample in toluene at room temperature for 1 hour and then immersing it in acetone at room temperature for 1 hour was repeated twice, followed by subjecting it to natural drying in a cold, dark, substantially windless place for 24 hours or more.

Reference Example 2

Carbon fiber bundles of Torayca (registered trademark) M35J, manufactured by Toray Industries, Inc., were cut with scissors and single fibers (carbon fiber) were sampled and evaluated. Results are shown in Table 1. Prior to performing the evaluation, a procedure of immersing the carbon fiber bundle sample in toluene at room temperature for 1 hour and then immersing it in acetone at room temperature for 1 hour was repeated twice, followed by subjecting it to natural drying in a cold, dark, substantially windless place for 24 hours or more.

Reference Example 3

Carbon fiber bundles of Torayca (registered trademark) M40J, manufactured by Toray Industries, Inc., were cut with scissors and single fibers (carbon fiber) were sampled and evaluated. Results are shown in Table 1. Prior to performing the evaluation, a procedure of immersing the carbon fiber bundle sample in toluene at room temperature for 1 hour and then immersing it in acetone at room temperature for 1 hour was repeated twice, followed by subjecting it to natural drying in a cold, dark, substantially windless place for 24 hours or more.

Reference Example 4

Carbon fiber bundles of Torayca (registered trademark) M46J, manufactured by Toray Industries, Inc., were cut with scissors and single fibers (carbon fiber) were sampled and evaluated. Results are shown in Table 1. Prior to performing the evaluation, a procedure of immersing the carbon fiber bundle sample in toluene at room temperature for 1 hour and then immersing it in acetone at room temperature for 1 hour was repeated twice, followed by subjecting it to natural drying in a cold, dark, substantially windless place for 24 hours or more.

Reference Example 5

Carbon fiber bundles of Torayca (registered trademark) T300, manufactured by Toray Industries, Inc. and having a filament number of 1,000, were cut with scissors and single fibers (carbon fiber) were sampled and evaluated. Results are shown in Table 1. Prior to performing the evaluation, a procedure of immersing the carbon fiber bundle sample in toluene at room temperature for 1 hour and then immersing it in acetone at room temperature for 1 hour was repeated twice, followed by subjecting it to natural drying in a cold, dark, substantially windless place for 24 hours or more.

TABLE 1

| | precursor | | carbonization treatment | | filament | carbon fiber | |
|---|---|---|---|---|---|---|---|
| | fiber single fiber fineness dtex | twisting treatment twist count turns/m | maximum temperature ° C. | tension mN/dtex | number during carbonization step number | single fiber diameter μm | single fiber elastic modulus GPa |
| Example 1 | 1.1 | 100 | 1,400 | 1.5 | 12,000 | 7.5 | 276 |
| Example 2 | 1.1 | 75 | 1,400 | 1.5 | 12,000 | 7.5 | 276 |
| Example 3 | 1.1 | 50 | 1,400 | 1.5 | 12,000 | 7.5 | 274 |
| Example 4 | 1.1 | 100 | 1,900 | 3.5 | 12,000 | 7.4 | 325 |
| Example 5 | 1.1 | 75 | 1,900 | 3.5 | 12,000 | 7.4 | 330 |
| Example 6 | 1.1 | 50 | 1,900 | 3.5 | 12,000 | 7.4 | 333 |
| Example 7 | 1.1 | 100 | 1,400 | 6.9 | 12,000 | 7.2 | 322 |
| Example 8 | 1.1 | 75 | 1,400 | 8.2 | 12,000 | 7.2 | 319 |
| Example 9 | 1.1 | 50 | 1,400 | 7.8 | 12,000 | 7.2 | 321 |
| Example 10 | 1.1 | 100 | 1,900 | 5.4 | 12,000 | 7.4 | 345 |
| Example 11 | 1.1 | 75 | 1,900 | 6.1 | 12,000 | 7.4 | 350 |
| Example 12 | 1.1 | 50 | 1,900 | 5.2 | 12,000 | 7.3 | 345 |
| Example 13 | 1.1 | 50 | 1,900 | 10.2 | 12,000 | 7.2 | 370 |
| Example 14 | 1.1 | 75 | 1,900 | 3.5 | 24,000 | 7.4 | 326 |
| Example 15 | 1.1 | 75 | 1,900 | 8.0 | 24,000 | 7.3 | 359 |
| Example 16 | 1.1 | 30 | 1,900 | 1.5 | 12,000 | 7.5 | 313 |
| Example 17 | 1.1 | 20 | 1,900 | 10.3 | 12,000 | 7.2 | 381 |
| Example 18 | 0.8 | 45 | 1,400 | 10.3 | 12,000 | 5.3 | 344 |
| Example 19 | 1.1 | 30 | 1,900 | 11.1 | 24,000 | 7.1 | 390 |
| Example 20 | 1.1 | 50 | 1,900 | 9.9 | 24,000 | 7.3 | 341 |

| | carbon fiber | | | | |
|---|---|---|---|---|---|
| | average crystallite size $L_c(s)$ nm | average orientation parameter of crystallites $\pi_{002}(s)$ % | formula (1) * | undulation width of single fiber μm | variation coefficient of undulation width % |
| Example 1 | 1.99 | 81.8 | true | 14.5 | 42 |
| Example 2 | 1.99 | 82.1 | true | 9.2 | 55 |
| Example 3 | 1.98 | 82.0 | true | 5.5 | 60 |
| Example 4 | 2.74 | 84.3 | true | 14.0 | 50 |
| Example 5 | 2.75 | 84.2 | true | 9.3 | 57 |
| Example 6 | 2.74 | 84.2 | true | 6.0 | 52 |
| Example 7 | 2.01 | 82.7 | true | 15.6 | 48 |
| Example 8 | 2.02 | 82.7 | true | 8.7 | 59 |
| Example 9 | 2.03 | 82.9 | true | 5.1 | 46 |
| Example 10 | 2.78 | 85.2 | true | 14.9 | 47 |
| Example 11 | 2.81 | 85.5 | true | 10.1 | 52 |
| Example 12 | 2.85 | 85.5 | true | 5.8 | 45 |
| Example 13 | 2.95 | 87.1 | true | 6.4 | 57 |
| Example 14 | 2.73 | 84.3 | true | 14.6 | 54 |
| Example 15 | 2.83 | 86.3 | true | 15.3 | 48 |
| Example 16 | 2.75 | 83.3 | false | 3.0 | 51 |
| Example 17 | 2.96 | 86.8 | true | 2.6 | 43 |
| Example 18 | 2.12 | 85.5 | true | 2.8 | 48 |
| Example 19 | 2.84 | 87.0 | true | 3.0 | 63 |
| Example 20 | 2.84 | 86.8 | true | 5.2 | 64 |

| | precursor | | carbonization treatment | | filament | carbon fiber | |
|---|---|---|---|---|---|---|---|
| | fiber single fiber fineness dtex | twisting treatment twist count turns/m | maximum temperature ° C. | tension mN/dtex | number during carbonization step number | single fiber diameter μm | single fiber elastic modulus GPa |
| Comparative Example 1 | 1.1 | 15 | 1,400 | 1.0 | 12,000 | 7.5 | 274 |

TABLE 1-continued

| | | | | | | | |
|---|---|---|---|---|---|---|---|
| Comparative Example 2 | 1.1 | 0 | 1,900 | 7.5 | 12,000 | 7.1 | 360 |
| Comparative Example 3 | 1.1 | 0 | 1,400 | 5.4 | 12,000 | 7.4 | 301 |
| Reference Example 1 | — | — | — | — | 12,000 | 7.0 | 232 |
| Reference Example 2 | — | — | — | — | 12,000 | 5.2 | 333 |
| Reference Example 3 | — | — | — | — | 12,000 | 5.2 | 350 |
| Reference Example 4 | — | — | — | — | 12,000 | 5.1 | 413 |
| Reference Example 5 | — | — | — | — | 1,000 | 6.9 | 228 |

| | carbon fiber | | | | |
|---|---|---|---|---|---|
| | average crystallite size $L_c(s)$ nm | average orientation parameter of crystallites $\pi_{002}(s)$ % | formula (1) — | undulation width of single fiber μm | variation coefficient of undulation width % |
| Comparative Example 1 | 2.06 | 81.6 | true | 1.8 | 43 |
| Comparative Example 2 | 2.82 | 85.7 | true | 1.4 | 110 |
| Comparative Example 3 | 2.01 | 82.3 | true | 0.8 | 123 |
| Reference Example 1 | 1.97 | 81.3 | true | 0.6 | 181 |
| Reference Example 2 | 3.30 | 85.9 | false | 2.2 | 87 |
| Reference Example 3 | 3.66 | 88.0 | true | 1.8 | 102 |
| Reference Example 4 | 4.93 | 90.5 | false | 2.4 | 82 |
| Reference Example 5 | 1.80 | 80.3 | false | 0.8 | 58 |

* "true" means meeting formula (1), and "false" means failing to meet formula (1).

INDUSTRIAL APPLICABILITY

Our carbon fiber has the morphological feature that the fiber axis is undulated to a certain degree or more, which is a feature that cannot be seen in the other existing carbon fibers. Since the undulated form prevents the single fibers from stacking on top of each other and allow them to exhibit high dispersibility during the molding process for producing a carbon fiber reinforced composite material or in the final molded article, this serves to realize a reduction in the processing cost and an improvement in mechanical characteristics of carbon fiber reinforced composite materials, thus ensuring a high industrial applicability.

The invention claimed is:

1. A twisted carbon fiber comprising a plurality of single fibers having lengths of 10 cm or less, a fiber axis of each single fiber having an undulation width of 2.5 μm to 15.6 μm when a part thereof between two points with a straight-line distance of 1 mm is observed from a lateral direction, and a coefficient of variation in the undulation width being 100% or less, wherein an average crystallite size $L_c$ is 2.3 nm to 3.0 nm, wherein an average crystallite size $L_c$ and an average orientation parameter of crystallites $\pi_{002}$ of the single fibers satisfies formula (1):

$$\pi_{002}(s) \geq 4.0 \times L_c(s) + 73.2 \quad (1),$$

wherein an elastic modulus of the single fibers is 200 GPa or more.

2. The twisted carbon fiber as set forth in claim 1, wherein an average crystallite size $L_c$ and an average orientation parameter of crystallites π002 of the single fibers satisfies formula (2):

$$\pi_{002}(s) \leq 3.1 \times L_c(s) + 81.8 \quad (2).$$

3. The twisted carbon fiber as set forth in claim 1, wherein the diameter of the single fibers is 3.0 μm or more.

4. The twisted carbon fiber as set forth in claim 1, wherein the diameter of the single fibers is 6.1 μm or more.

5. A twisted carbon fiber comprising:

a plurality of single fibers having lengths of 10 cm or less, a fiber axis of each single fiber having an undulation width of 2.5 μm to 15.6 μm when a part thereof between two points with a straight-line distance of 1 mm is observed from a lateral direction, and a coefficient of variation in the undulation width being 42% to 100%, wherein an average crystallite size $L_c$ is 2.3 nm to 3.0 nm, wherein an average orientation parameter of crystallites $\pi_{002}$ of the single fibers is 80% to 90%;

wherein an average crystallite size $L_c$ and an average orientation parameter of crystallites $\pi_{002}$ of the single fibers satisfies formula (1):

$\pi_{002}(s) \geq 4.0 \times L_c(s) + 73.2$ (1); and wherein an elastic modulus of the single fibers is 200 GPa to 390 GPa.

6. The twisted carbon fiber of claim 5, wherein coefficient of variation in the undulation width is 42% to 64%.

7. The twisted carbon fiber of claim 5, wherein elastic modulus of the single fibers is 274 GPa to 390 GPa.

* * * * *